United States Patent [19]

Matsumoto et al.

[11] Patent Number: 4,720,307

[45] Date of Patent: Jan. 19, 1988

[54] METHOD FOR PRODUCING HIGH STRENGTH STEEL EXCELLENT IN PROPERTIES AFTER WARM WORKING

[75] Inventors: Kazuaki Matsumoto; Seishi Tsuyama; Hisatoshi Tagawa; Yoshitaka Yamasaki, all of Fukuyama, Japan

[73] Assignee: Nippon Kokan Kabushiki Kaisha, Tokyo, Japan

[21] Appl. No.: 847,288

[22] Filed: Apr. 2, 1986

[30] Foreign Application Priority Data

May 17, 1985 [JP] Japan ..... 60-103843
Feb. 25, 1986 [JP] Japan ..... 61-38217

[51] Int. Cl.[4] ..... C21D 7/14
[52] U.S. Cl. ..... 148/12 R; 148/12 F
[58] Field of Search ..... 148/12 R, 12 F, 2

[56] References Cited

U.S. PATENT DOCUMENTS 4,406,711 9/1983 Nagumo et al. ..... 148/12 R

*Primary Examiner*—R. Dean
*Attorney, Agent, or Firm*—Frishauf, Holtz, Goodman & Woodward

[57] ABSTRACT

A steel which is excellent in mechanical properties after a warm working process is produced by specifying a chemical composition as claimed, subjecting the steel to a controlled rolling under conditions at temperatures of not more than 900° C. and accumulated reduction of more than 30%, leaving it, after the controlled rolling, as it is in the air or performing it to an accelerated cooling wherein the steel is cooled at rate between the air cooling and 100° C./sec until temperatures where a transformation finishes, subsequently reheating the steel to ranges between 400° C. and 750° C., and carrying out the warm working thereon instantaneously or after the air cooling at the temperatures between 250° C. and 750° C.

14 Claims, 2 Drawing Figures

METHOD FOR PRODUCING HIGH STRENGTH STEEL EXCELLENT IN PROPERTIES AFTER WARM WORKING

BACKGROUND OF THE INVENTION

The present invention relates to a method for producing high strength steels by so-called TMCP (Thermo-mechanical Control Process), which exhibit excellent properties after warm working.

Steels to be used to offshore structural materials or the like are required to have high strength and high toughness, and this kind of steel has been conventionally produced by normalizing or quenching-tempering treatment.

Recently, techniques such as controlled rolling or accelerated cooling for producing steel plates of heavy thickness, have been advanced and distributed as TMCP, and applied to the offshore structural steels.

The steels of TMCP type are imparted with the high strength and high toughness by rolling at ranges of low temperatures of austenite or at $(\alpha+\gamma)$ intercritical range, otherwise by controlling transformation from austenite to ferrite by the accelerated cooling after rolling.

The steels for the offshore structures are subjected to bending when setting up, and generally steels of small thickness or low strength are performed with cold working, and steels of thickness are done with warm working.

If the steel of TMCP type were re-heated up to the austenite range for the warm working, it would be more deteriorated in properties than conventional materials. Although, in the cold working, no problem arises about the properties, but as it has been possible to produce steels of high strength and heavy thickness, a problem occurs that the cold working could not be performed because of pressing ability.

In view of such a problem, a warm working process which performs processing after having heated at $\alpha$ high temperature range or $(\alpha+\gamma)$ intercritical range, has been applied to TMCP steels of high strength or heavy thickness, and there have been many proposals for this technique. However, there has never yet been a proposal which has been studied, including mechanical properties after the warm working process.

SUMMARY OF THE INVENTION

This invention has been realized from the above mentioned circumstances of the conventional techniques, and is to provide steels which are excellent in the mechanical properties after the warm working process by specifying respectively conditions of steel composition, hot rolling and warm working process.

With respect to the chemical composition, the present method limits to such steels of C: 0.03 to 0.20%, Si: not more than 0.6%, Mn: 0.5 to 2.0%, sol.Al: 0.005 to 0.08%, and the rest being Fe and inavoidable impurities. Further, one or more may be added of Nb: 0.005 to 0.1%, V: 0.005 to 0.15%, Ti: 0.005 to 0.15%, Cu: not more than 1.0%, Cr: not more than 1.0%, Ni: not more than 3.5%, Mo: not more than 1.0%, and B: 0.0005 to 0.003%.

The steel having the above mentioned composition is subjected to the controlled rolling under conditions at temperatures of not more than 900° C. and accumulated reduction of more than 30%. After the controlled rolling, the steel may be left as it is in the air, or it may be performed with the accelerated cooling wherein the steel is cooled at rate between the air cooling and 100° C./sec until temperatures where the transformation finishes. Subsequently, it is heated to ranges between 400° C. and 750° C., and instantaneously or after the air cooling it is warm-worked at the temperatures between 250° C. and 750° C.

By the above process, it is possible to produce the steel excellent in properties after the warm working process.

DETAILED DESCRIPTION OF THE INVENTION

An explanation will be made to the most typical condition of the hot working process.

Figure 1:
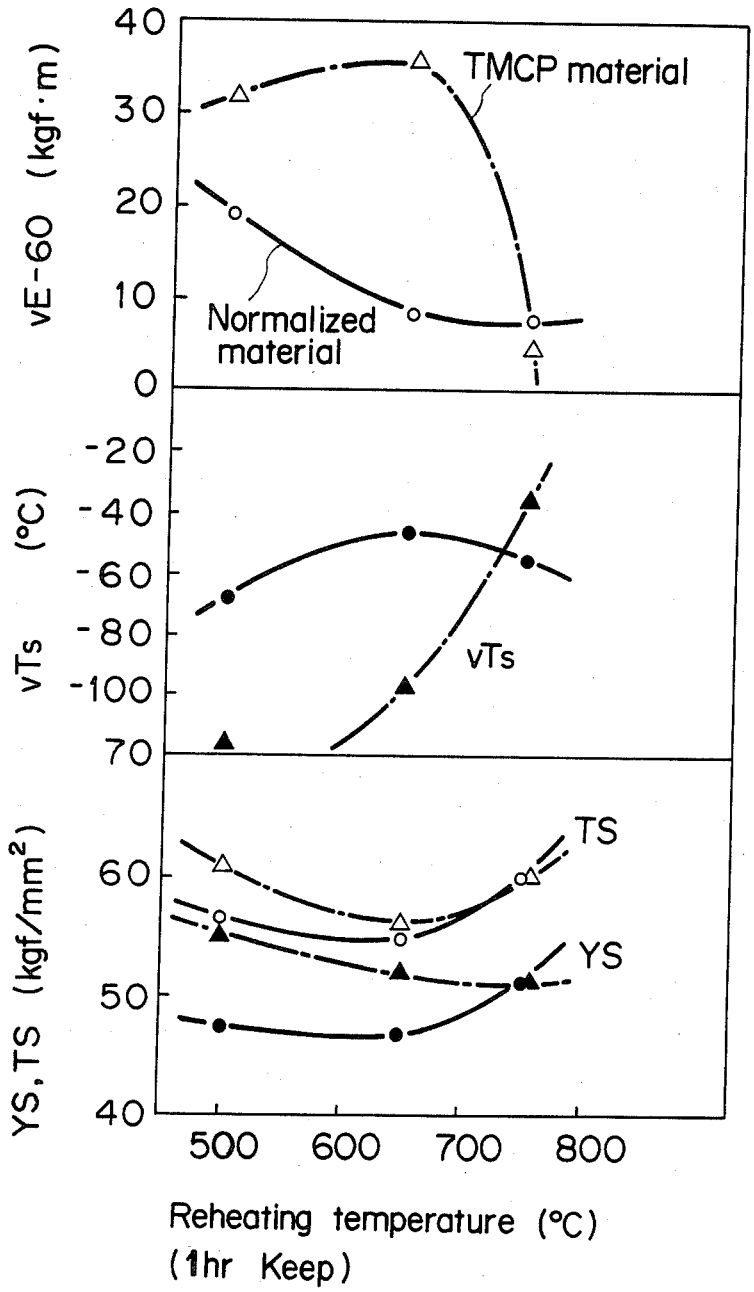
FIG. 1 is a graph showing changes by the heating temperatures of mechanical characteristics of TMCP and normalized material.

FIG. 1 plots the mechanical properties of the conventional normalized material (marked with ○) and TMCP material (marked with Δ) affected with the accelerated cooling after the controlled rolling, which are heated to the temperatures of 500° to 750° C. and undertaken with the warm working of 10% at the temperature of 500° C.

As is seen from this graph, TMCP material is better than the normalized material at the temperature between 500° C. and 650° C., but almost the same level at the temperature of 750° C. A reason is assumed why the effects of the controlled rolling and the accelerated cooling are maintained at the heating temperature below $Ac_1$, thereby to enable to provide properties of high grade, but on the other hand, when reheating at the $(\alpha+\gamma)$ intercritical range above $Ac_1$, the steel structure is changed, thereby to eliminate the effects of the controlled rolling and the accelerated cooling.

Figure 2:
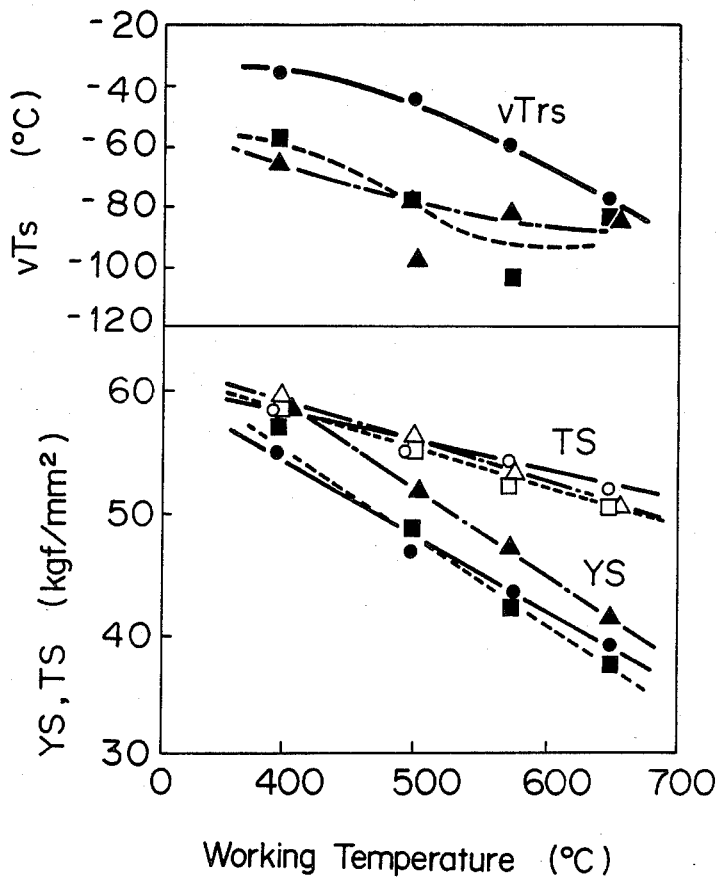
FIG. 2 is a graph showing relationship between warm working temperatures and mechanical properties.

FIG. 2 show the relationship between the warm working temperature and the mechanical properties wherein the normalized material (marked ○) and TCMP material (marked Δ and □) are reheated at the temperature of 650° C. and held for one hour, and warm-worked at the respective temperatures. It is seen from the same that the steels (Δ and □) of TMCP type have excellent toughness in comparison with the normalized steel (○), and Nb-addition steel (Δ) has high YS. Although the warm working temperature becomes 400° to 250° C., satisfied properties are obtained and no cracks are observed.

The chemical compositions of the normalized material (○) and TMCP materials (Δ and □) are shown under.

| | C | Si | Mn | P | S | Cu | Ni | Cr | Mo | Ti | Nb | V | B | sol. Al |
|---|---|---|---|---|---|---|---|---|---|---|---|---|---|---|
| Normalized material○ | .10 | .39 | 1.56 | .008 | .002 | .18 | .28 | — | — | — | .29 | — | — | .025 |
| TMCP Δ | .06 | .32 | 1.56 | .008 | .001 | .25 | .41 | — | — | .01 | .009 | — | — | .063 |

-continued

| | C | Si | Mn | P | S | Cu | Ni | Cr | Mo | Ti | Nb | V | B | sol. Al |
|---|---|---|---|---|---|---|---|---|---|---|---|---|---|---|
| material □ | .07 | .30 | 1.47 | .011 | .001 | .21 | .36 | — | — | .01 | — | — | — | .060 |

The steel produced under the proper controlled rolling or the accelerated cooling conditions is undertaken with the proper conditions, so that the steel excellent in the mechanical properties may be produced which has never been produced in the foregoing materials.

The present invention limits the reheating temperatures to 400° to 750° C., preferably $Ac_1$ to 400° C., and the warm working temperature to 250° to 750° C., preferably $Ac_1$ to 400° C.

A reason for determining the upper limit of the temperature is as said above. With respect to the heating temperature, if the lower limit were below 400° C., the warm working temperature would be lowered and merits of the warm working process is little obtained. With respect to the warm working temperature, if it were less than 250° C., the warm working temperature would be still lowered and the merits of the warm working process would be little obtained, and the lower limit is determined preferably at 400° C. in order to avoid a range of blue brittleness.

After having reheated to the above mentioned temperature, the warm working process may be carried out instantaneously or after the air cooling, and if it were performed within the above specified temperatures, the effects by the present invention could be obtained. The cooling rate after the warm working process gives little influences to the properties, and therefore it is not especially limited.

A further explanation will be made to the reasons for limiting the composition and other producing conditions.

C: 0.03% is required for giving the strength of this kind of steel most economically and effectively, but if it were above 0.2%, a weldability would be considerably deteriorated, and it is determined 0.03% to 0.2%.

Si: it is effective for giving high strength through solid strength, but since much addition deteriorates the weldability, it is specified not more than 0.6%.

Mn: it is added as a basic element for improving the strength and toughness of the steel, but if it were less than 0.5%, its effect would be little, and if it were more than 2.0%, the weldability would be deteriorated, and it is determined 0.5 to 2.0%.

Sol.Al: at least 0.005% is required for deoxidizing the steel, since its effect is saturated when it exceeds 0.08%, it is set 0.005 to 0.08%.

The under mentioned elements may be, if required, added to the above basic composition.

Cu, Cr, Ni and Mo: by addition thereof, the solid solution hardening and the strength may be provided through changes in the structure based on the increase of quenching property of the steel, but from the viewpoint of the weldability and the economics, Cu, Cr and Mo are set 1.0% in the upper limit and Ni is 3.5% of the upper limit.

Nb, V and Ti: they have remarkable effects in improving of toughness at the low temperatures and increasing of the strength, and are added as occasions demand, and it is necessary to add any one of them more than 0.005% for displaying said effect, and the lower limit is determined at 0.005%. If they were added much, the weldability would be deteriorated, and therefore, Nb is 0.10% in the upper limit, and V and Ti are 0.15%, respectively.

B: it has a large effect in increasing of the hardenability and increasing of the strength, but if being less than 0.0005%, the effect would be little, and if exceeding 0.003%, the weldability would be deteriorated. Thus, the range is set 0.0005 to 0.003%.

In the invention, the thus controlled steel is subjected to the hot rolling such that the accumulated reduction under 900° C. is more than 30%. With a reduction rate of less than 30%, the effect of the controlled rolling could not be enough obtained, and the strength and toughness would be insufficient. In other words, for carrying out the controlled rolling of the practical steels, the reduction is performed at non-recrystallizing range of austenite and the transformed structure should be made fine. In the steels including Nb, V and Ti, the upper limit of the temperature of the non-recrystallizing range is 900° C., and this temperature is set as the upper limit. In the steels not including these elements, the upper limit thereof is 900° C. minus about 50° C. but in the actual operation if the upper limit is set not more than 900° C., differences would be little, and therefore the lower limit is determined 900° C. After the hot rolling, the steel may be left in the air as it is, or performed with the accelerated cooling.

With respect to the accelerated cooling conditions after the hot rolling, since the improving effect of the property is noted by cooling the transforming range faster than the air cooling, it is sufficient that the lower limit of the accelerated cooling is faster than the air cooling until the transformation finishes, and the upper limit is 100° C./sec which is allowed in an apparatus.

If the steel is as-control rolled or performed with the warm working process after the accelerated cooling, the steel excellent in the properties may be produced.

EXAMPLE

Steels of the chemical compositions shown in Table 1 were hot rolled under the conditions shown in Table 2 and performed with the warm working process under the conditions shown in Table 3, and the mechanical properties were studied. Results are shown in Table 3.

Steels 1 and 6 were normalized and not conducted with the control roll. Steels 2, 3, 5 and 8 were effected with the accelerated cooling after the control rolling. Steels 4 and 7 were as-control rolled.

As is seen from Table 3, each of the steels which performed with the warm working process under the condition of this invention after the control rolling, has the excellent characteristics, and especially is superior to the normalized steels 1 and 6. The comparative steels 11 and 12 were conducted with the accelerated cooling after the controlled rolling, but since the temperatures of the warm working process was outside of the specified range in this invention, the toughness was largely deteriorated.

Table 3 shows influences of strain amount caused during the warm working process to the material properties and of the stress-relieving (SR) for removing residual stress after the warm working process. These results show that the residual stress amount up to 10%

(which is normal rate) and SR treatment do not give big influences to the characteristics of the steel after the warm working process.

TABLE 1

| Steels | C | Si | Mn | P | S | Cu | Ni | Cr | Mo | Ti | Nb | V | B | Sol Al |
|---|---|---|---|---|---|---|---|---|---|---|---|---|---|---|
| | Chemical composition (%) | | | | | | | | | | | | | |
| 1 | 0.10 | 0.39 | 1.56 | 0.008 | 0.002 | 0.18 | 0.28 | — | — | — | 0.29 | — | — | 0.025 |
| 2 | 0.07 | 0.30 | 1.47 | 0.011 | 0.001 | 0.21 | 0.36 | — | — | 0.01 | — | — | — | 0.060 |
| 3 | 0.06 | 0.32 | 1.56 | 0.008 | 0.001 | 0.25 | 0.41 | — | — | 0.01 | 0.009 | — | — | 0.063 |
| 4 | 0.10 | 0.29 | 1.38 | 0.020 | 0.005 | — | — | 0.20 | 0.15 | 0.01 | — | 0.04 | — | 0.059 |
| 5 | 0.08 | 0.29 | 1.52 | 0.018 | 0.004 | 0.12 | 0.20 | — | — | 0.01 | 0.012 | — | 0.001 | 0.060 |
| 6 | 0.15 | 0.31 | 1.55 | 0.016 | 0.005 | — | — | — | — | — | — | — | — | 0.026 |
| 7 | 0.12 | 0.30 | 1.52 | 0.015 | 0.004 | — | — | — | — | — | — | — | — | 0.032 |
| 8 | 0.11 | 0.35 | 1.49 | 0.012 | 0.004 | — | — | — | — | — | — | — | — | 0.029 |

TABLE 2

| Steels | Controlled reduction (%) at temp. of not more 900° C. | Accelerated cooling conditions |
|---|---|---|
| | Manufacturing conditions | |
| 1* | 0 | — |
| 2 | 40 | 730 → 500° C. 10° C./sec |
| 3 | 60 | 750 → 400° C. 10° C./sec |

TABLE 2-continued

| Steels | Controlled reduction (%) at temp. of not more 900° C. | Accelerated cooling conditions |
|---|---|---|
| | Manufacturing conditions | |
| 4 | 50 | Air cooling |
| 5 | 60 | 700° C. → Room temp. 40° C./sec |
| 6* | 0 | — |
| 7 | 40 | Air cooling |
| 8 | 60 | 780 → 500° C. 15° C./sec |

*910° C. Normalizing

TABLE 3

| | Kinds | Nos. | A* B (°C.) | A* C (°C.) | A* D (%) | E | F (6ϕ × 30 GL)** YS (Kgf/mm²) | F TS (Kgf/mm²) | F El (%) | G (2 mm CVN)** νE-60 (Kgf · m) | G νTs (°C.) |
|---|---|---|---|---|---|---|---|---|---|---|---|
| | | | Mechanical properties of test steel pieces | | | | | | | | |
| Comparative materials | Steels 1 | 1 | 750 | 500 | 10 | — | 51.3 | 60.0 | 35 | 7.6 | −55 |
| | | 2 | 650 | — | — | — | 35.9 | 49.5 | 47 | 29.6 | −92 |
| | | 3 | " | 650 | 10 | — | 38.8 | 51.7 | 42 | 28.8 | −79 |
| | | 4 | " | 575 | 10 | — | 43.5 | 53.9 | 35 | 13.5 | −60 |
| | | 5 | " | 500 | 5 | — | 41.2 | 51.6 | 45 | 25.5 | −68 |
| | | 6 | " | " | 10 | — | 46.7 | 54.8 | 33 | 8.5 | −46 |
| | | 7 | " | " | 10 | 600° C. × 2 h | 38.9 | 52.0 | 39 | 15.9 | −58 |
| | | 8 | " | 400 | 10 | — | 54.7 | 58.0 | 27 | 1.5 | −36 |
| | | 9 | " | 250 | 10 | — | 57.1 | 57.6 | 31 | 1.1 | −24 |
| | | 10 | 500 | 500 | 10 | — | 47.5 | 56.4 | 38 | 19.3 | −68 |
| | Steels 3 | 11 | 800 | 800 | 10 | — | 46.6 | 52.9 | 32 | 1.1 | −21 |
| | | 12 | 650 | 200 | 10 | — | 55.2 | 58.4 | 18 | 1.2 | −24 |
| Inventive materials | Steels 2 | 13 | 650 | — | — | — | 35.8 | 48.7 | 44 | 38.8 | −117 |
| | | 14 | " | 650 | 10 | — | 37.4 | 50.2 | 46 | 37.0 | −84 |
| | | 15 | " | 575 | 10 | — | 42.0 | 52.0 | 46 | 36.6 | −105 |
| | | 16 | " | 500 | 5 | — | 43.7 | 51.3 | 42 | 37.0 | −89 |
| | | 17 | " | " | 10 | — | 48.5 | 54.8 | 35 | 29.2 | −79 |
| | | 18 | " | " | 10 | 600° C. × 2 h | 38.7 | 51.0 | 41 | 36.9 | −92 |
| | | 19 | " | 400 | 10 | — | 56.8 | 58.2 | 34 | 14.6 | −58 |
| | Steels 3 | 20 | 750 | 500 | 10 | — | 51.2 | 59.9 | 34 | 4.4 | −36 |
| | | 21 | 650 | — | — | — | 42.8 | 50.2 | 43 | 37.7 | −84 |
| | | 22 | " | 650 | 10 | — | 41.5 | 50.4 | 43 | 37.8 | −87 |
| | | 23 | " | 575 | 10 | — | 46.9 | 52.9 | 38 | 35.8 | −82 |
| | | 24 | " | 500 | 5 | — | 50.0 | 53.8 | 37 | 35.5 | −74 |
| | | 25 | " | " | 10 | — | 52.0 | 55.8 | 39 | 35.6 | −98 |
| | | 26 | " | " | 10 | 600° C. × 2 h | 43.1 | 51.9 | 39 | 34.8 | −110 |
| | | 27 | " | 400 | 10 | — | 58.2 | 59.0 | 30 | 28.8 | −66 |
| | | 28 | " | 250 | 10 | — | 56.7 | 58.7 | 23 | 11.3 | −66 |
| | | 29 | 500 | 500 | 10 | — | 55.0 | 60.7 | 33 | 31.7 | <−130 |
| | Steels 4 | 30 | 650 | 500 | 5 | — | 49.4 | 54.9 | 39 | 32.3 | −103 |
| | | 31 | " | " | 10 | — | 50.9 | 57.5 | 37 | 31.0 | −92 |
| | Steels 5 | 32 | " | " | 5 | — | 49.1 | 54.5 | 40 | 34.2 | −104 |
| | | 33 | " | " | 10 | — | 50.5 | 56.3 | 39 | 33.8 | −107 |
| Com. | Steels 6 | 34 | 650 | 650 | 10 | — | 38.0 | 52.1 | 42 | 6.5 | −43 |
| | | 35 | " | 500 | " | — | 46.9 | 55.5 | 34 | 1.9 | −30 |
| | | 36 | " | " | " | 600° C. × 2 h | 37.2 | 51.3 | 44 | 4.2 | −37 |
| Inv. | Steels 7 | 37 | " | 650 | " | — | 37.7 | 52.8 | 43 | 28.3 | −81 |
| | | 38 | " | 500 | " | — | 47.3 | 55.9 | 34 | 25.3 | −72 |
| | | 39 | " | " | " | 600° C. × 2 h | 37.5 | 51.9 | 43 | 29.4 | −84 |
| | Steels 8 | 40 | " | 650 | " | — | 39.2 | 53.4 | 40 | 30.5 | −84 |
| | | 41 | " | 500 | " | — | 48.1 | 56.1 | 35 | 26.2 | −79 |

TABLE 3-continued

| | | Mechanical properties of test steel pieces | | | | | | | | |
|---|---|---|---|---|---|---|---|---|---|---|
| | | A* | | | | F (6ϕ × 30 GL)** | | | G (2 mm CVN)** | |
| Kinds | Nos. | B (°C.) | C (°C.) | D (%) | E | YS (Kgf/mm²) | TS (Kgf/mm²) | El (%) | νE-60 (Kgf · m) | νTs (°C.) |
| | 42 | " | " | " | 600° C. × 2 h | 38.4 | 52.7 | 41 | 31.3 | −86 |

*Reheating rate 200° C./hr maintaining for 1 hr
**Obtained from 1/4t c direction
A: Warm working conditions,
B: Reheating temperature,
C: Warm working temperatures,
D: Warm working strain,
E: SR treatment,
F: Tensile properties,
G: impact properties

What is claimed is:

1. A method for producing high tension steel having excellent properties after warm working comprising, subjecting a steel consisting essentially of C: 0.03 to 0.20%, Si: not more than 0.6%, Mn: 0.5 to 2.0%, sol.Al: 0.005 to 0.08%, Nb: 0 to 0.1%, V: 0 to 0.15%, Ti: 0 to 0.15%, Cu: 0 to 1.0%, Cr: 0 to 1.0%, Ni: 0 to 3.5%, Mo: 0 to 1.0%, B: 0 to 0.003% and the balance essentially Fe, to a controlled hot rolling of at least 30% of accumulated reduction at temperatures of not more than 900° C., reheating said steel up to temperatures between 400° C. and 750°, and then carrying out a warm working at temperatures between 250° C. and 700° C. with cooling between said reheating and said warm working being no more rapid than air cooling.

2. The method of claim 1, comprising further containing any one of Nb: 0.005 to 0.1%, V: 0.005 to 0.15%, Ti: 0.005 to 0.15%, and B: 0.0005 to 0.003%.

3. The method of claim 1, wherein the steel, after the controlled hot rolling step, is given an accelerated cooling at rate of more than the air cooling to 100° C./sec down to temperatures at which transformation is finished, after which said steel is reheated to between 400° C. and 750° C. and warm worked.

4. The method for producing high tension steel excellent in properties after hot working comprising, subjecting a steel consisting essentially of C: 0.03 to 0.20%, Si: not more than 0.6%, Mn: 0.5 to 2.0%, sol.Al: 0.005 to 0.08%, any one of Nb: 0.005 to 0.1%, V: 0.005 to 0.15%, Ti: 0.005 to 0.15%, Cu: not more than 1.0% than 1.0%, Cr: not more than 1.0%, Ni: not more than 3.5%, Mo: not more than 1.0% and B: 0.0005 to 0.003% and the rest being Fe and inavoidable impurities, to a hot rolling of at least 30% of accumulated reduction at temperatures of not more than 900° C., performing an accelerated cooling at rate of more than the air cooling to 100° C./sec until temperatures where a transformation is finished, heating said transformed steel up to temperatures between 400° C. and 750° C., and carrying out a warm working at temperatures between 250° C. and 700° C. with cooling between said heating and said warm working being at a rate no faster than air cooling.

5. The method of claim 1 wherein said reheating step is conducted at a temperature between $Ac_1$ and 400° C.

6. The method of claim 1 wherein said warm working step is conducted at a temperature between $Ac_1$ and 400° C.

7. The method of claim 5 wherein said reheating step is conducted at a temperature not substantially higher than about 650° C.

8. The method of claim 6 wherein said warm working step is conducted at a temperature not higher than about 650° C.

9. A method for producing high tension steel having excellent properties after warm working comprising subjecting a steel consisting essentially of about 0.03% to 0.2% carbon, not more than 0.6% silicon, about 0.5% to 2% manganese, about 0.005% to 0.08% soluble aluminum and the balance essentially iron to a controlled hot rolling of at least 30% of accumulated reduction at a temperature of not more than about 900° C., reheating said hot rolled steel up to temperatures between 400° C. and 750° C., then warm working said reheated steel at temperatures between 250° C. and 700° C. with any cooling between said reheating and said warm working being no more rapid than air cooling.

10. The method of claim 9 wherein said hot rolled steel is given an accelerated cooling at a rate of more than air cooling to 100° C./sec. down to temperatures at which transformation is finished and then reheating said steel to between 400° C. and 750° C. and warm working said reheated steel.

11. The method of claim 10 wherein said reheating step is conducted at a temperature between $Ac_1$ and 400° C.

12. The method of claim 10 wherein said warm working step is conducted at a temperature between $Ac_1$ and 400° C.

13. The method of claim 10 wherein said reheating step is conducted at a temperature not substantially higher than about 650° C.

14. The method of claim 10 wherein said warm working step is conducted at a temperature not higher than about 650° C.

* * * * *